US006086052A

United States Patent [19]

Rowe

[11] Patent Number: 6,086,052

[45] Date of Patent: Jul. 11, 2000

[54] FOAM GENERATING APPARATUS

[76] Inventor: Carroll G. Rowe, P.O. Box 69, Washington, Ark. 71862

[21] Appl. No.: 09/014,873

[22] Filed: Jan. 28, 1998

Related U.S. Application Data

[63] Continuation-in-part of application No. 08/759,888, Dec. 3, 1996, Pat. No. 5,837,168.

[51] Int. Cl.[7] ..... B01F 3/04

[52] U.S. Cl. ..... 261/18.1; 169/14; 169/16; 261/78.2; 261/DIG. 26

[58] Field of Search ..... 261/76, 78.2, 18.1, 261/DIG. 26; 425/4 R, 4 C, 817 R, 817 C; 169/14–16, 44

[56] References Cited

U.S. PATENT DOCUMENTS

| | | | |
|---|---|---|---|
| 2,988,151 | 6/1961 | Dion-Biro | 169/14 |
| 3,701,482 | 10/1972 | Sachnik | 239/590.3 |
| 3,703,345 | 11/1972 | Giesemann | 425/4 |
| 3,836,076 | 9/1974 | Conrad et al. | 239/8 |
| 3,946,947 | 3/1976 | Schneider | 239/401 |
| 4,040,975 | 8/1977 | Wittersheim | 252/239 E |
| 4,278,132 | 7/1981 | Hostetter | 169/13 |
| 4,452,917 | 6/1984 | Proksa et al. | 261/DIG. 26 |
| 4,460,711 | 7/1984 | Jacobson | 261/DIG. 26 |
| 4,474,680 | 10/1984 | Kroll | 252/307 |
| 4,492,525 | 1/1985 | Bilyeu | 417/34 |
| 4,505,431 | 3/1985 | Huffman | 239/428 |
| 4,630,774 | 12/1986 | Rehman et al. | 239/8 |
| 4,729,434 | 3/1988 | Rohrbach | 169/24 |
| 4,802,630 | 2/1989 | Kromrey et al. | 239/428 |
| 4,830,790 | 5/1989 | Stevenson | 261/18.1 |
| 4,869,849 | 9/1989 | Hirose et al. | 261/DIG. 26 |
| 4,981,178 | 1/1991 | Bundy | 261/DIG. 26 |
| 5,012,979 | 5/1991 | Williams | 261/DIG. 26 |
| 5,113,945 | 5/1992 | Cable | 261/DIG. 26 |
| 5,255,747 | 10/1993 | Teske et al. | 261/DIG. 26 |
| 5,275,763 | 1/1994 | Fukai | 261/78.2 |
| 5,364,031 | 11/1994 | Taniguchi et al. | 239/330 |
| 5,398,765 | 3/1995 | Worthington | 169/52 |
| 5,427,181 | 6/1995 | Laskaris et al. | 261/DIG. 26 |
| 5,492,655 | 2/1996 | Morton et al. | 261/76 |
| 5,538,027 | 7/1996 | Adamson et al. | 137/7 |
| 5,837,168 | 11/1998 | Rowe | 261/78.2 |

OTHER PUBLICATIONS

Brochure, "Firecracker by Marco," Newkirk, OK, 2 pgs. undated.

Brochure, untitled, Magee Fire Equipment, Inc., Mesquite, TX Oct. 10, 1994, 4 pgs.

Brochure, "The Mallory Compressed Air Foam System (CAFS)," The Mallory Company, Kelso, WA, 3 pgs, undated.

Brochure, "NK60–FM180–CH25 CAF Pump Unit," Pneumax, Peoria, AZ, 6 pgs. undated.

"Class A Foam and Foam Systems," David Abernathy, Pittsburg, TX, 19 pgs, undated.

"Low–volume, medium–expansion foam nozzle . . . from your workshop," *Firequip*, vol. 8, No. 1 (1992), US Dept. of Interior.

*Primary Examiner*—Richard L. Chiesa
*Attorney, Agent, or Firm*—J. Charles Dougherty

[57] ABSTRACT

Apparatus for generating foam for use in fire fighting having two plates housed in a chamber which respectively introduce pressurized air and a water/surfactant solution between the two plates where foam is generated and emitted from an aperture on the side of the chamber. The pressurized water/soap solution enters the chamber through an orifice in one plate. Pressurized air enters the chamber through a number of channels bored through the other plate, such channels appearing in an annular grove which circumscribes the water inlet. The plates are provided with surfaces which are brought together to form a restricted area therebetween. The restricted area balances the pressure between the incoming water and the incoming air by achieving an equilibrium at some particular radius out from the center of the two plates. This equilibrium radius moves in and out from the center as necessary to keep the two pressures balanced. The apparatus also includes a pressure regulating system that automatically cuts off the flow of pressurized water and air when the foam dispensing nozzle is turned off.

21 Claims, 7 Drawing Sheets

FOAM GENERATING APPARATUS

The present application is a continuation-in-part of application Ser. No. 08/759,888, filed Dec. 3, 1996, now U.S. Pat. No. 5,837,168 which is considered as being part of the disclosure of the present application and is hereby incorporated by reference herein.

BACKGROUND OF THE INVENTION

The present invention relates to devices for generating foam for use in fire fighting and specifically to a foam generator which provides for automatic balancing of pressure differentials between incoming pressurized water and pressurized air.

Foam generators utilizing pressurized water and pressurized air in combination with a surfactant are useful in fire fighting. There are certain well known means of mixing air, water, and a surfactant to generate foam, including mixing chambers, venturis, and nozzles.

U.S. Pat. No. 4,981,178 issued to Bundy on Jan. 1, 1991 discloses an apparatus for generating fire-fighting foam using a mixing chamber.

U.S. Pat. No. 4,505,431 issued to Huffman on Mar. 19, 1985 for "Apparatus for Discharging Three Commingled Fluids" and U.S. Pat. No. 4,474,680 issued to Kroll on Oct. 2, 1984 for "Foam Generating Apparatus and Method" disclose venturi-type foam generators.

It has been very difficult in the past to produce a simple device for generating foam from the mixing of pressurized air and pressurized water. (The foam also requires the presence of a soap or surfactant which is introduced into the water prior to the foam generator.) Pressure balancing between incoming pressurized air and incoming pressurized water requires elaborate measures to control both the air volume and pressure and the water volume and pressure. It has generally been necessary to use very complicated devices to balance the volumes and pressures or to require the operator to manually adjust the volumes and pressures on a continuous basis during operation to maintain a balance. Thus a skilled operator is typically required to operate such systems.

If a balanced pressure is not maintained, the quality of the foam being generated can be affected. Various types of foam may be desirable for particular applications. In some situations a dry foam is desirable; in other situations, a wetter foam is desirable. Too much water or too much air can result in a foam that is not efficient for the intended purpose. For example, in some situations, the most desirable type of foam contains sufficient moisture to aid in smothering a fire while it is sufficiently dry to cling to surfaces. If a balanced pressure and volume of water and air is not maintained, the result can be a foam that is either too wet or too dry or that has other deficiencies with respect to the desired quality. The volume of water in relation to the volume of air determines the consistency of the generated foam, so the control of both pressure and volume is necessary to assure the desired foam quality.

The prior art emphasizes the importance of maintaining balanced pressures between the water and air supplies. Bundy, at column 3, beginning at line 12, discusses the problem of achieving the proper combination of air pressure and volume with water pressure and volume to achieve the desired quality of foam. Bundy also discusses the desirability of maintaining equal pressure in the air and water supplies.

The prior art has addressed the problem of balancing the air and water supply pressure in a foam generator by various expedients as mentioned above. Even with the fairly complex and expensive means employed, the operation of a foam generating apparatus for fire fighting requires the services of an experienced operator and even then much experimentation is necessary. For example, even the simple act of changing a hose attached to the apparatus often requires difficult and time consuming rebalancing of the system.

It has been suggested that a high degree of turbulence may contribute to the quality of foam produced in that a finer foam structure is obtained. Foam comprised of large bubbles is less useful for typical fire-fighting applications. It may therefore be desirable to both balance the pressures of the incoming water and air and do so in a way that maximizes turbulence.

Prior foam generating systems lack a means to automatically cut off the flow of water and air into the system's hose when the hose nozzle is turned off. This may create an unsafe condition if system air and water pressures are not precisely balanced. If the system water pressure exceeds the system air pressure, closing the nozzle may cause a "slug" of water to build inside the hose. When the operator again opens the nozzle and expects a relatively low-density foam to emerge, the slug of water that squirts forth may cause the operator to lose control of the hose. Conversely, if the system air pressure exceeds the system water pressure, a pocket of air may build in the hose when the nozzle is closed. Subsequent opening of the nozzle may send forth a burst of oxygen onto a flame thereby aiding the spread of a fire rather than extinguishing it. Either a slug of water or burst of air may thus result in serious injury to the hose operator or bystanders. Given the difficulty in prior art foam generating systems of maintaining a precise balance between system air and water pressure, it has been difficult to prevent these unsafe conditions.

The problems and limitations of the prior art are overcome by the present invention as summarized below.

SUMMARY OF THE INVENTION

The present invention is an apparatus for generating foam for use in fire fighting. The invention utilizes a unique mixing chamber designed to automatically balance the dynamic pressure of incoming air and water streams and thereby produce high-quality foam even if the incoming static air and water pressure vary significantly. This allows the foam generator to work in a wide variety of situations and environments, even with makeshift compressor and pump equipment, without the necessity of complicated calibration steps. Such versatility is highly desirable for firefighting, especially in rural areas where specialized equipment may be unavailable.

In the present invention, pressurized water (including a surfactant) and pressurized air are introduced in such a way as to automatically achieve the desired balance between water and air pressures, and also produce a highly turbulent environment which conduces to the formation of a high quality foam. The apparatus includes an automatic regulator that stops the flow of air and water when the nozzle is turned off, thereby preventing the safety hazard created if the hose were to fill with unmixed water or air. This automatic regulator also prevents the backpressure in the hose from exceeding either the incoming air or water pressure.

The water and air pressures in a foam generator derive from three components: a static or head pressure, which is the input pressure from the water pump and air compressor of the system; a dynamic pressure within the mixing chamber, which is determined by the flow rate of water and air input into the chamber; and a residual pressure or backpressure from the hose. Prior art foam generators have attempted to balance the static water and air pressure. In conventional systems, this balance is necessary since if either pressure exceeds the other, it will prevent the formation of high-quality foam. Thus conventional foam generators are only effective for firefighting purposes if the input air and water are at precisely the same pressure.

The present invention, by contrast, focuses on dynamic pressure as a means to both balance the water and air pressure within the mixing chamber and to achieve a highly turbulent environment conducive to excellent foam quality. In the present invention, water is introduced into a restricted area in the mixing chamber with an ever-widening area for expansion as it travels farther toward the air source. The water pressure falls as the water travels through the widening area approaching the air inlets, such that a point is eventually reached where the water pressure falls to equal the air pressure it encounters. If either the static air or water pressure is changed, the equalization point may move further or closer to the air or water inlets, but will still lie somewhere between the two inlets so that mixing will occur. Thus equalization of dynamic pressures takes place automatically due to the design of the mixing chamber. As long as the static pressures are maintained within a certain range, the system will automatically readjust and still deliver excellent-quality foam since an equalization pressure will still be reached. The energy lost as the water and air lose energy is converted into turbulence that serves to thoroughly mix the water and air and thereby produce high-quality foam.

In order to achieve this rapid conversion of the dynamic pressures of the incoming water and air into turbulent energy, the incoming water and air streams should be directed onto a surface which stops or splatters the streams, or against another stream. In addition to balancing the water and air pressures, the "splattering" effect also produces the highly desirable turbulent environment and separates the incoming water into fine droplets to speed mixing with the incoming air.

In the preferred embodiment of the invention, the heart of the foam generator is two plates housed in a chamber where pressurized air and water are introduced into the restricted area between the two plates. The pressurized water is introduced through an opening in one plate. The pressurized air is introduced into the restricted area through a number of channels bored through the other plate. The air channels may appear in an annular grove, placed on the surface of the plate, that circumscribes the water inlet. While introducing the pressurized air into an annular groove is not necessary to the practice of the present invention, it does serve to improve mixing of the water and air by producing still more turbulence upon exit of the water and air from between the two plates.

In the preferred embodiment, the two plates are provided with flat surfaces, and when in operation, are in close proximity to each other. The narrow restricted area between the plates provides part of the mechanism that helps to equalize the pressure between the incoming water and the incoming air. Preferably the two plates are placed in such proximity that the turbulence effect created by the plate walls is significantly enhanced.

The water/surfactant solution and the air will intermingle in this restricted area in a highly turbulent fashion, and upon exiting the restricted area will produce a foam. The consistency of the foam can be adjusted by the operator by adjusting the incoming water pressure or volume, the incoming air pressure or volume, or by moving the plates relative to one another.

In some embodiments the air inlets may be set at an angle, such that the air inlets are turned somewhat toward the water inlet. It is believed that forcing the pressurized air between the plates at this angle, which preferably is about a 45°, creates even greater turbulence when the air and water meet, thus improving the quality of the resulting foam.

It is therefore an object of the present invention to provide for a self-balancing, foam-generating mechanism using pressurized water and pressurized air.

A further object of the present invention is to provide for a foam-generating mechanism using pressurized water and pressurized air which is simple and economical to construct and easy to operate.

An additional object of the present invention is to provide for a foam-generating mechanism using pressurized water and pressurized air which produces varying qualities and quantities of foam and accepts varying lengths and types of hoses without requiring complicated and delicate rebalancing of air and water pressures.

A further object of the present invention is to provide for a foam-generating mechanism using pressurized water and pressurized air that may be used with a wide assortment of different compressors and water pump mechanisms and may be operated by less skilled persons.

A still further object of the present invention is to provide for highly turbulent mixing of the pressurized water and air to produce an exceptionally high-quality foam.

Yet another object of the present invention is to provide a foam-generating mechanism with a regulator that automatically cuts off the flow of pressurized air and water into the system when the nozzle is closed, thus preventing the dangerous situation of a slug of water or burst of air emerging from the hose when the nozzle is reopened.

Further objects and advantages of the present invention will be apparent from a consideration of the following detailed description of the preferred embodiments in conjunction with the appended drawings as briefly described following.

DETAILED DESCRIPTION OF THE PREFERRED EMBODIMENTS

Figure 1:
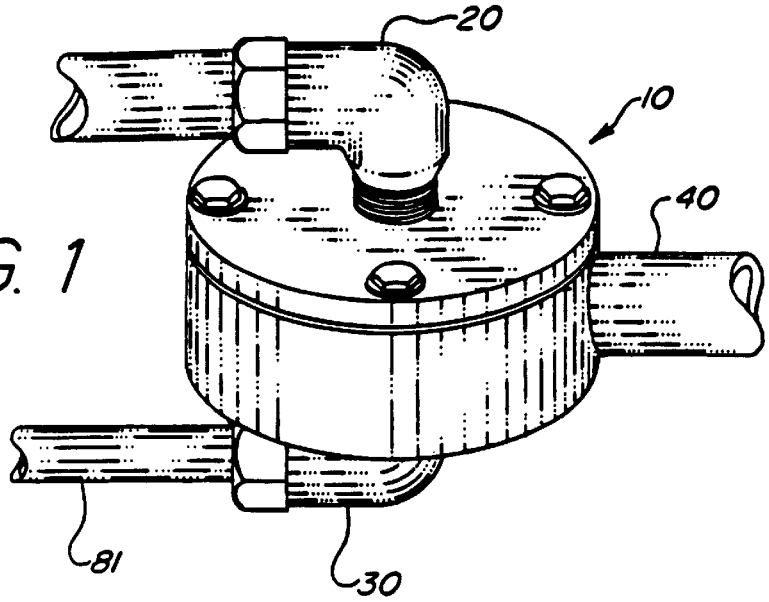
FIG. 1 is an exterior perspective view of a chamber containing the foam generating plates and having incoming lines for pressurized water and air and an exit for foam generated in the chamber.

The present invention may be described with reference to FIGS. 1 and 2. A chamber 10 is provided which accepts an incoming pressurized water line 20 and pressurized air line 313. Foam generated in the chamber 10 exits through the outlet 40.

The heart of the present invention is found in the provision for two plates 50, 60 where the incoming water and air are introduced to each other. The shape of the chamber 10 in which the foam is generated is not critical to the invention, although the chamber 10 should allow space around the plates 50, 60 for the generated foam to exit. Furthermore, it is desirable to avoid shaping the chamber 10 such that a spiraling action is induced in the foam. Such action can separate foam into its primary constituents by centrifugal force.

The pressurized water plate 50 is simply a circular disc 51 with a bore 52 through the center for the introduction of pressurized water to a restricted area 70 between the plates 50, 60. The bore 52 may be reduced by an orifice for better control of the pressure and for adjustment of the volume of the incoming water. As will be discussed hereinafter, the pressurized water contains an admixture of surfactant which is introduced to the pressurized water prior to the chamber 10 by various means well known in the art.

Figure 2:
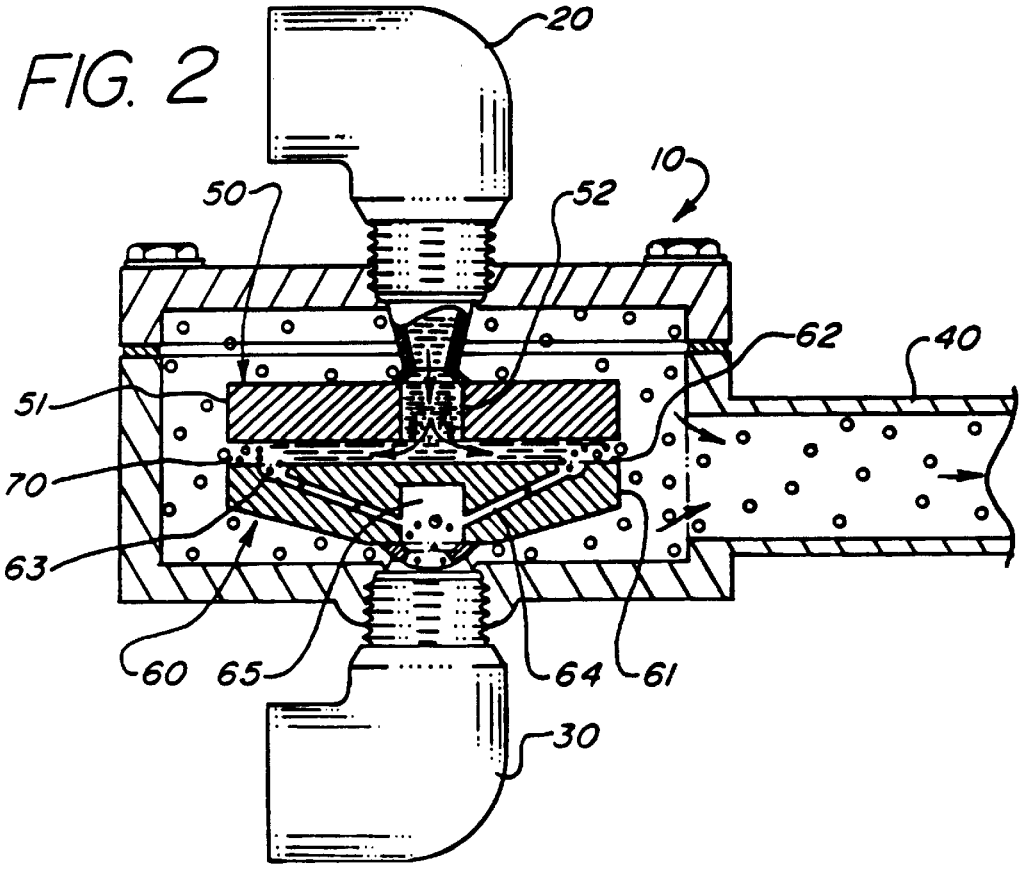
FIG. 2 is a sectional elevation view of the chamber of FIG. 1 showing the pressurized water plate and the pressurized air plate located to the top and bottom respectively of the chamber with the foam generating area therebetween.
Figure 3:
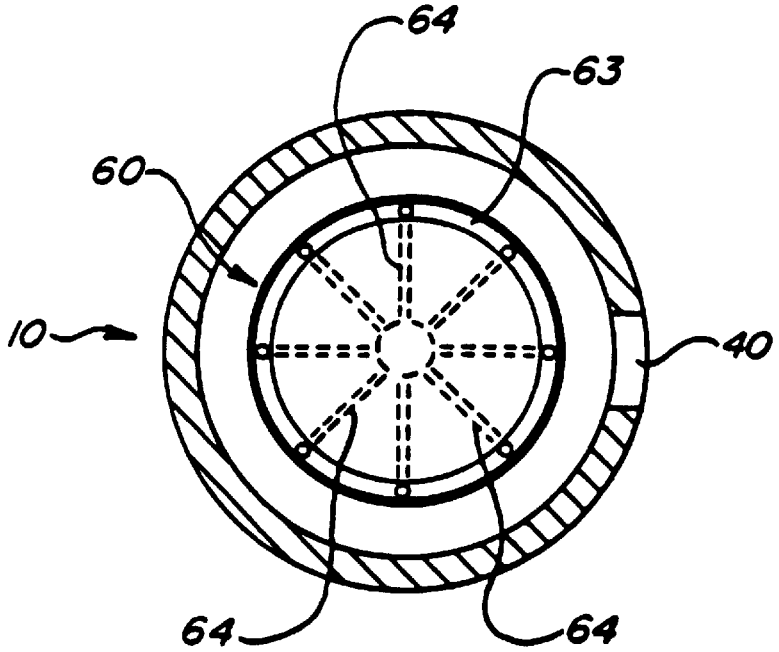
FIG. 3 is a sectional plan view of the chamber showing the pressurized air plate and the annular groove thereon.

As shown in FIGS. 2 and 3, the pressurized air plate 60 is likewise a circular disc 61 having a restricted area-facing surface 62 on which an annular groove 63 is disposed on the surface 62 and may be located at various radial distances from the periphery of the surface 62. In some embodiments, it may be desirable to place surface roughening features such as ripples or grooves between the annular groove 63 and the periphery of the surface 62 in order to enhance turbulence and mixing. The annular groove 63 is fed pressurized air from a plurality of radial passages 64 communicating with an inlet bore 65. The inlet bore 65 in turn communicates with the incoming pressurized air line 30. Alternatively, the radial passages 64 may be replaced by a plenum receiving pressurized air and communicating with the annular groove 63 by simple openings. When a plenum is employed it may be desirable to have the pressurized air enter the plenum at right angles to the openings communicating with the annular groove 63 in order to ensure an even pressure among the openings and therefore at all points on the annular groove 63.

Figure 4:
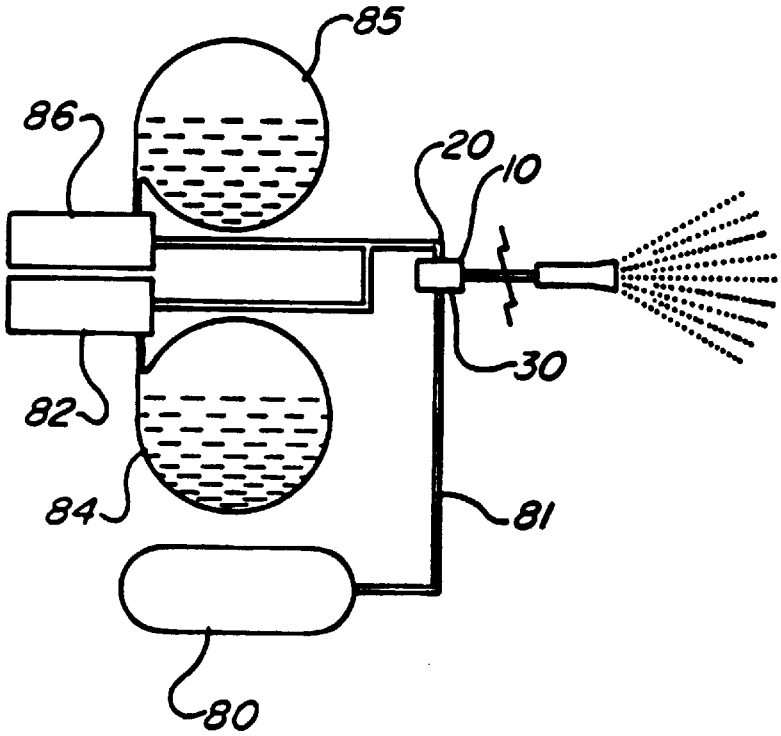
FIG. 4 is a schematic diagram showing the components of a complete foam generating system employing the present invention.

FIG. 4 is an overall schematic of a complete system incorporating the present invention showing an air compressor 80 connected by air line 81 leading to the air inlet 30 of the chamber 10, and a water pump 82 connected to water reservoir 84 and to water line 83 leading to the water inlet 20 of the chamber 10. Not shown are valves in the air line 81 and the water line 83 for setting the volume and pressure of the incoming water and air. Also shown in the schematic is a soap reservoir 85 and dispenser 86 into the water inlet line 83.

Figure 5:
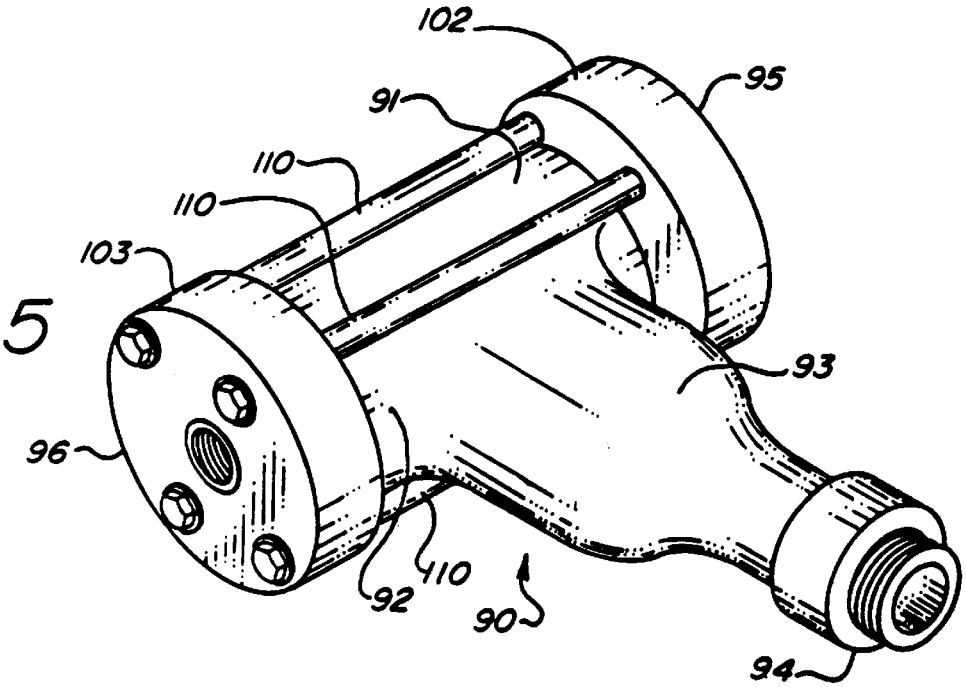
FIG. 5 is a perspective view of a second embodiment of the present invention for use in high pressure situations in which the plates are carried on respective plugs which are held to the chamber by bolts.
Figure 6:
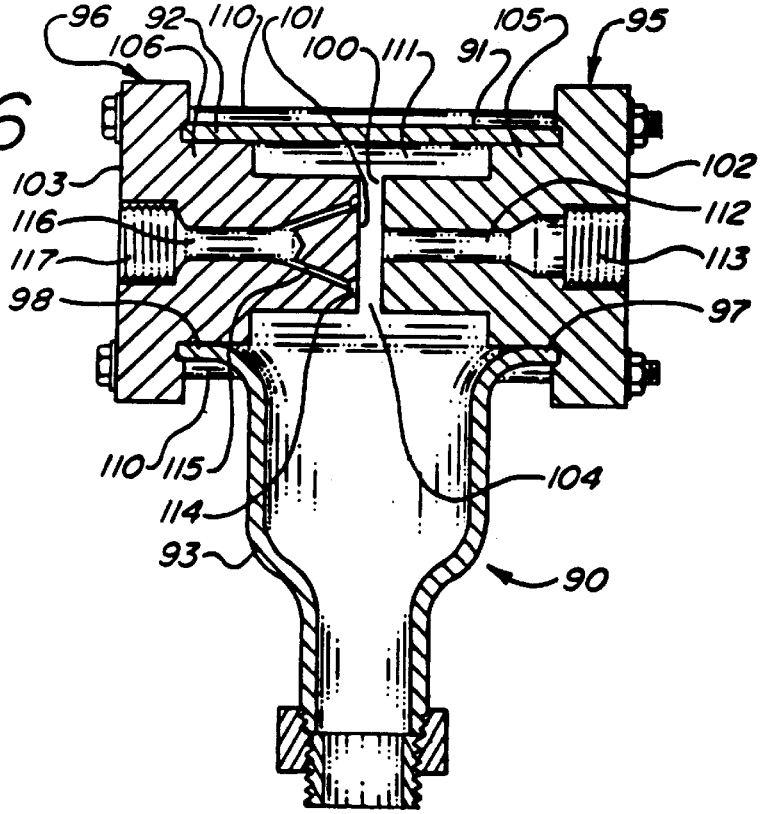
FIG. 6 is a sectional view of the embodiment of FIG. 5.

FIGS. 5 and 6 show a second preferred embodiment of the present invention. There are three primary pieces to the preferred embodiment of the foam generator of the present invention. The assembled foam generator is shown in perspective in FIG. 5. First, there is a housing 90, which is preferably constructed of stainless steel. The housing is a T-shaped hollow chamber having an water inlet section 91 and air inlet section 92 across the top of the "T" and a foam outlet section 93 at the base of the "T". The foam outlet section 93 at the base of the T-shaped chamber is reduced to a pipe which is the nozzle opening 94 or connection point for a hose. While the prior art normally uses the hose as part of the foam generating apparatus, the present invention requires only a minimal length of hose. Foam is generated in the housing 90 and available in close proximity to the nozzle opening 94.

Fitting into the housing 90 are two plugs 95, 96, preferably of plastic, which fit in respective open ends 97, 98 of the water inlet section 91 and air inlet section 92, respectively, at the top of the T of the housing 90. These two plugs 95, 96 incorporate the plates 100, 101, which introduce pressurized water and air into the restricted area 104 between the two plates 100, 101.

A section of the embodiment of FIG. 5 showing the two plates 100, 101 is given in FIG. 6. Each plug 100, 101 is provided with a flange 102, 103, respectively, which fits against the respective open ends 97, 98, and serve to fix the plugs into position so as to form a restricted area 104 of the requisite width. Each plug 95, 96 is reduced to a middle section 105, 106 sized to fit tightly in either open end 97, 98. Each plug is further reduced to an inner section 107, 108. When the two plugs 95, 96 are assembled into the housing 90, the restricted area 102 between the two plugs 95, 96 is set at the desired distance.

Plate 100 introduces pressurized water into the restricted area 102 through a bore 112 which is connected to the inlet water supply by an integral water inlet connection 113. Likewise, plate 101 introduces pressurized air into the restricted area 102 through an annular groove 114 fed by radial passages 115 from an inlet bore 116 provided with an integral air inlet connection 117. The generation of foam is otherwise identical to that described above for the embodiment of FIGS. 1–4.

A device sized to deliver foam to a 1½ inch hose from a 100 psi water supply and 100 psi air supply would have inlets 91, 92 about 3 inches in diameter. The foam outlet section 93 at the base of the T-shaped chamber is reduced to a pipe approximately the diameter of the hose. In this sized embodiment, the outermost part of each flange 102, 103 is about 6 inches in diameter. Each plug 95, 96 is reduced to a 3 inch diameter middle section 105, 106 to fit tightly in either open end 97, 98. Each plug is further reduced to an inner section 107, 108 of about 2 inches in diameter. In this embodiment, when the two plugs 95, 96 are assembled into the housing 90, the restricted area 102 between the two plugs 95, 96 is preferably about 3/16 inch.

As shown in FIGS. 5 and 6, the two plugs 95, 96 are held to the housing 90 by four bolts 110 through holes in the flanges 102, 103. Although not critical, it is desirable that a space 111 be left around the plates 100, 101 and the restricted area 102 to allow the free exit of foam generated between the plates 100, 101.

Figure 7:
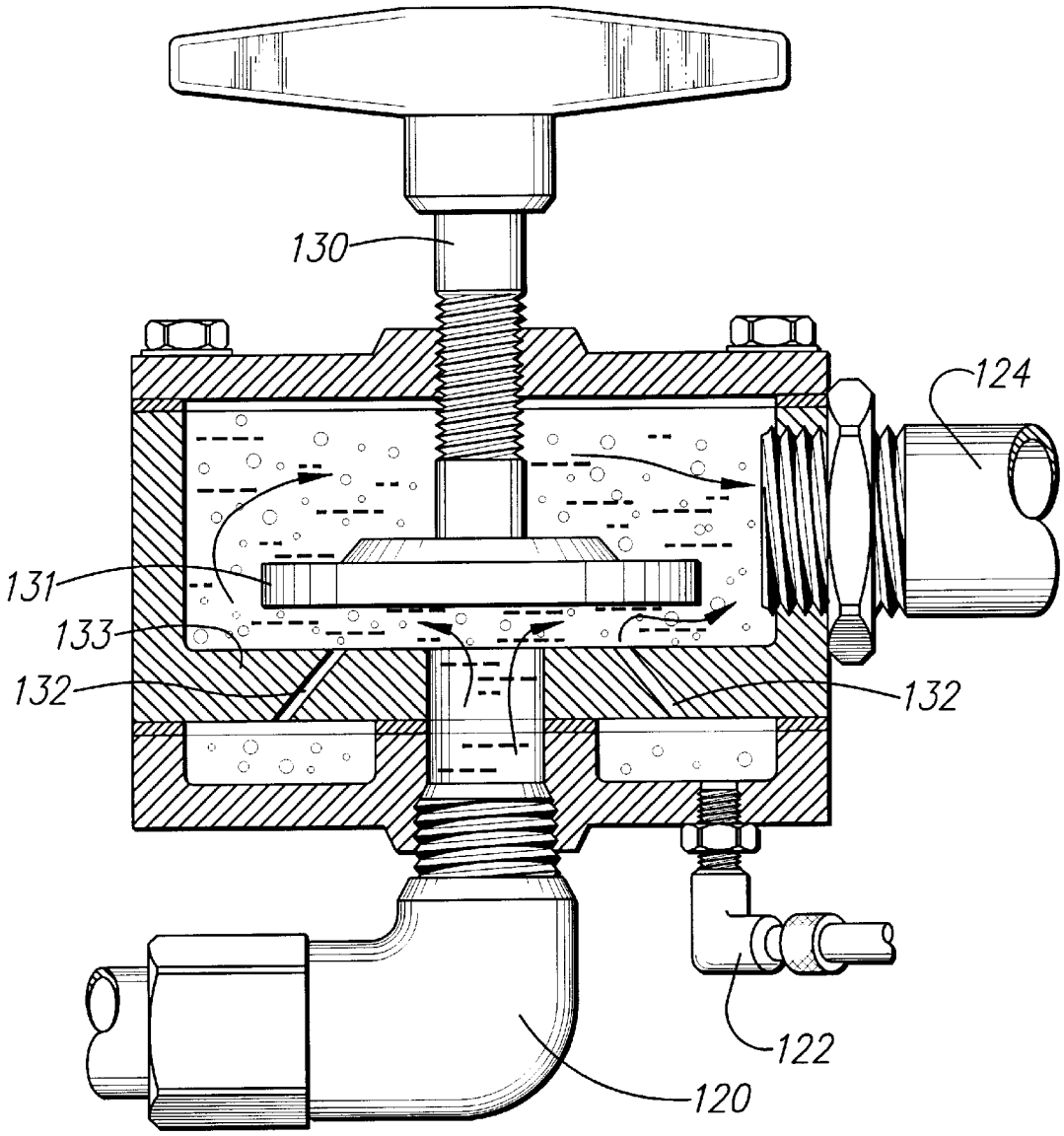
FIG. 7 is a sectional plan view of a third embodiment of the present invention with an adjustable distance between the plates and a foam exit tube that is perpendicular to the air and water inlets.

A third preferred embodiment of the present invention is shown in FIG. 7. This embodiment uses a chamber of generally cylindrical shape, with a water inlet 120 directed into the center of one end of the chamber. Air inlet 122 passes through this same end of the chamber, allowing pressurized air to pass into the chamber and then through air orifices 132 in first plate 133. Air orifices 132 are angled toward the center of the chamber and thus toward the direction that water will travel when it enters through water inlet 120 and strikes second plate 131. Second plate 131 includes an adjustment feature 130, which may be in the form of a threaded bolt that extends through the opposite end of the chamber. Adjustment feature 130 allows the operator to vary the width of the restricted area between first plate 133 and second plate 131 which will affect the type of foam that is produced. In this way the operator may create whichever type of foam is necessary for a given application, such as when a dryer foam is needed to adhere to vertical surfaces, or a wetter foam is needed for spraying foam long distances against a wind. The foam exits the chamber at foam outlet 124.

Figure 8:
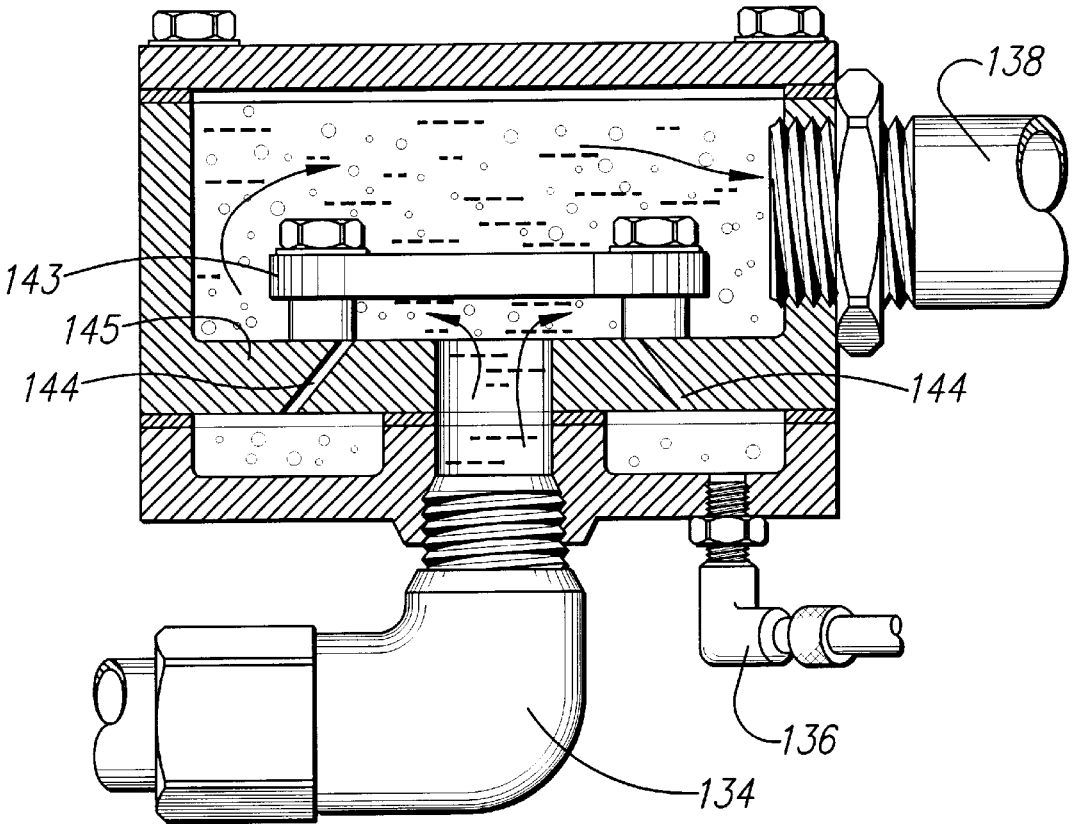
FIG. 8 is a sectional plan view of a fourth embodiment of the present invention having a fixed distance between the plates and a water inlet and foam outlet that are in line with one another.

A fourth preferred embodiment of the present invention is illustrated in FIG. 8. Like the embodiment of FIG. 7, this embodiment uses a chamber of generally cylindrical shape, with a water inlet 134 directed into the center of one end of the chamber. Air inlet 136 allows pressurized air to pass into the chamber and then through air orifices 144 in first plate 145. Air orifices 144 are angled as in the embodiment of FIG. 7. In this embodiment, second plate 143 is fixed in position relative to first plate 145 by bolts. The foam exits the chamber through foam outlet 138, which extends from the opposite end of the chamber through which water inlet 134 passes.

Figure 9:
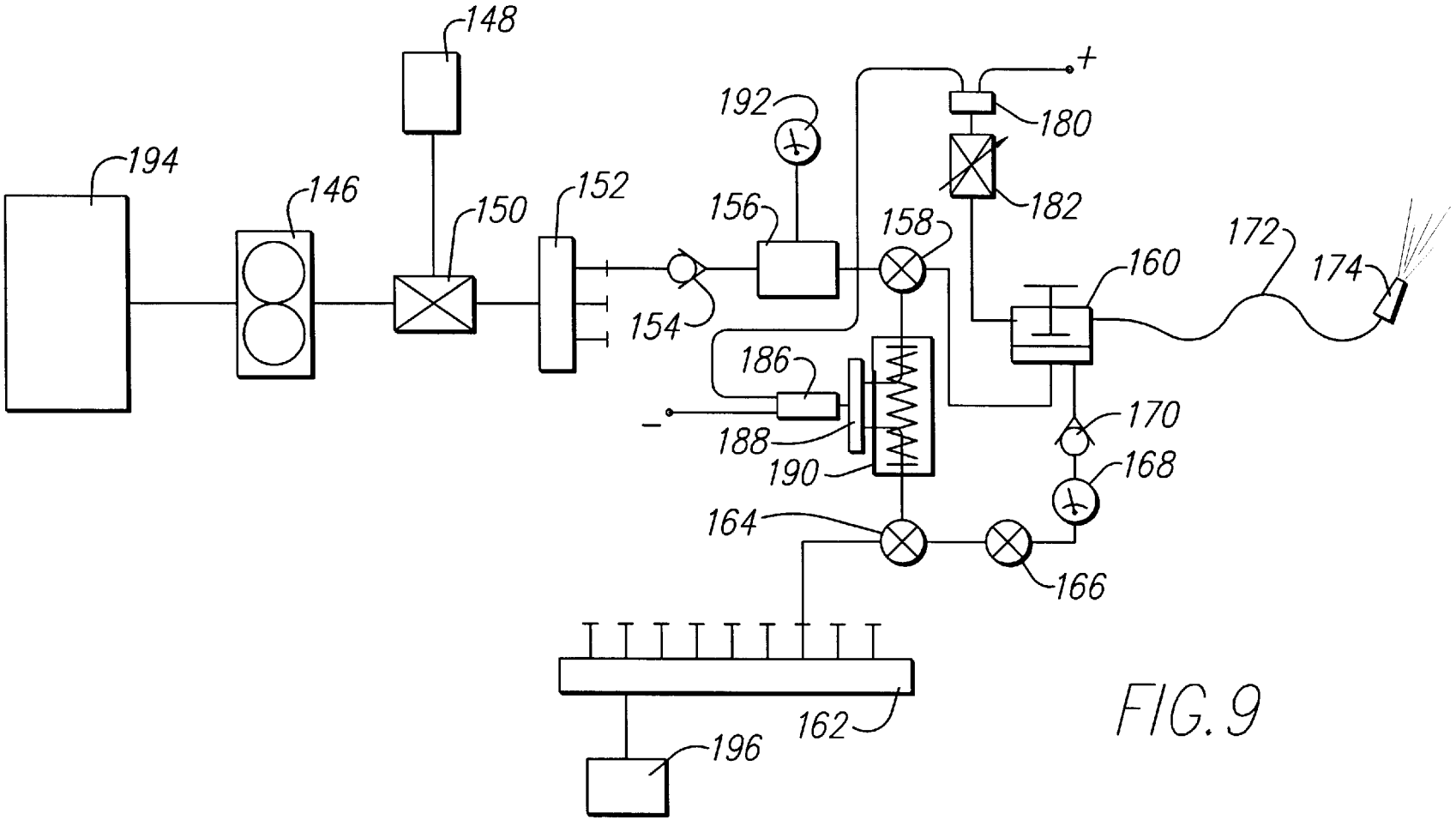
FIG. 9 is a schematic diagram showing a preferred embodiment of the regulator and automatic cut-off system of the present invention.
Figure 10:
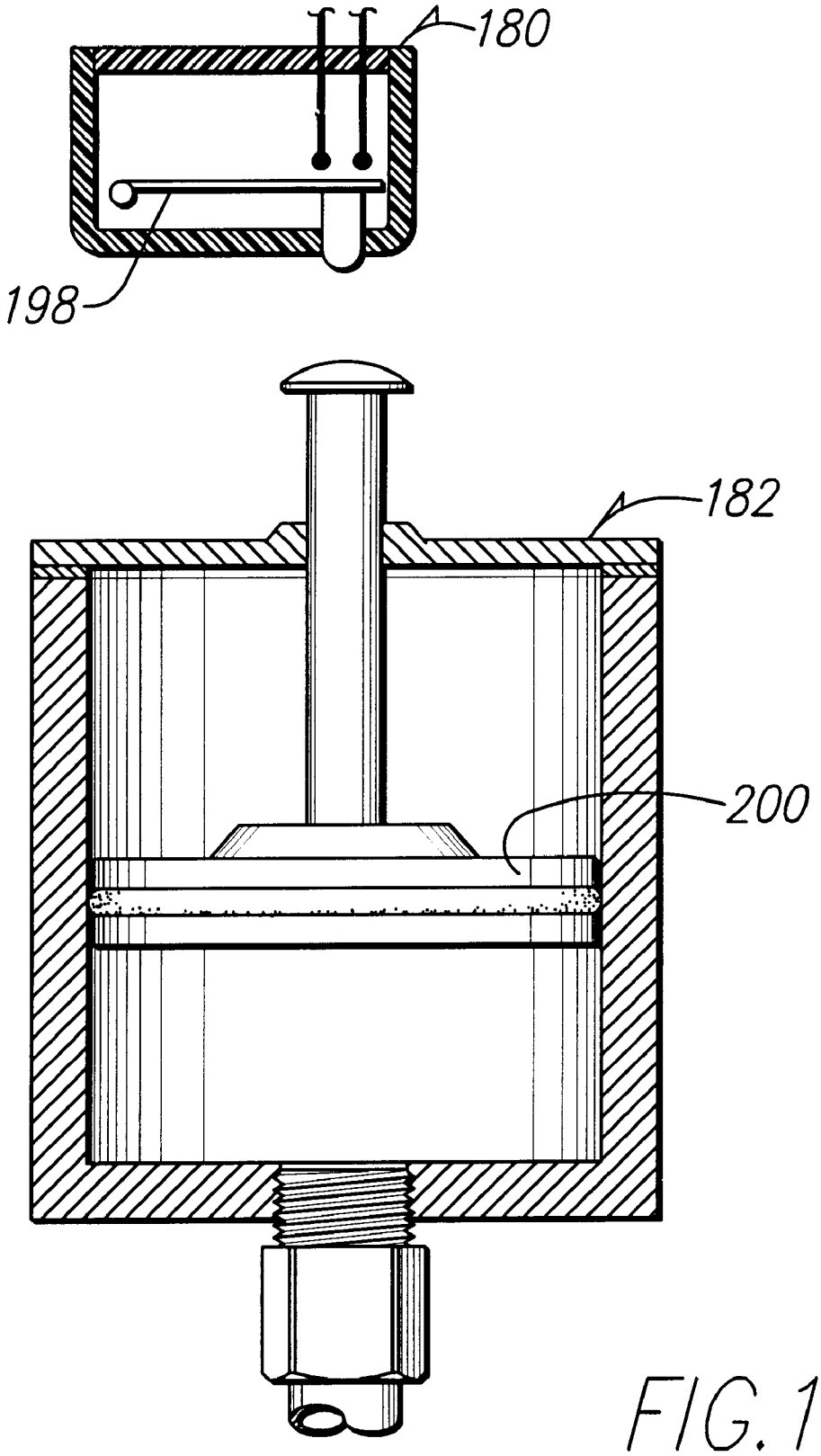
FIG. 10 is a schematic diagram of a detail section from FIG. 9 showing the operation of the pressure regulator cylinder and automatic cut-off microswitch.

The system by which air and water pressure is regulated in the preferred embodiment of the foam generator apparatus is illustrated in FIGS. 9 and 10. Water is drawn from water reservoir 194 and pressurized by water pump 146. A surfactant from soap reservoir 148 is added to the pressurized water by soap dispenser 150. The mixture is pumped through water manifold 152, then through water check valve 154 which prevents backflow of water or air through the system. Flow sensor 156 feeds flow information to flow indicator 192, which may be used by the operator to adjust the system to reach a desired volume of water per unit time. The water then flows through water valve 158 (the function of which will be described below) and into mixing chamber 160.

Turning now to the pressurized air side of the system, compressor 196 forces pressurized air through air manifold 162 and through air valve 164 (the function of which will be described below), then through flow control valve 166 and air flow meter 168. Based on the reading on air flow meter 168, the operator may adjust flow control valve 166 to reach a desired air flow volume per unit time. Air then flows through air check valve 170, which prevents the backflow of air or water through the system, and into mixing chamber 160. Foam created in mixing chamber 160 travels through hose 172 and out through nozzle 174.

Pressure regulator 182 (shown in detail in FIG. 10) is used to cut off the flow of air and water automatically when nozzle 174 is closed, thereby preventing the buildup of either a slug of water or burst of air in hose 172. When nozzle 174 is closed, backpressure builds in the hose and back through the chamber, which quickly exceeds the system static air pressure. This backpressure forces diaphragm 200 in pressure regulator 182 upward. The arm extending vertically from diaphragm 200 thus presses against contact arm 198 of microswitch 180, causing contact arm 198 to bridge the two electrical contacts of microswitch 180 and close the electrical circuit formed thereby. Closing this circuit activates electric solenoid 186, which ill turn actuates shut-off control valve 188, which simultaneously closes both water valve 158 and air valve 164. This prevents the flow of either water or air to mixing chamber 160, thus preventing the buildup of a slug of water or burst of air in hose 172 when nozzle 174 is closed.

Once nozzle 174 is opened again, the system backpressure will fall, thereby allowing diaphragm 200 to fall and opening the electrical circuit previously closed by contact arm 198 of microswitch 180. Spring return 190 will then simultaneously open water valve 158 and air valve 164. This will allow water and air to again enter chamber 160 and thus the system will begin generating foam again automatically.

Alternatively, the pressure regulator could use a controller (not shown) in communication with microswitch 180 that activates microswitch 180 when the system backpressure rises above a threshold value. Once microswitch 180 is activated, water valve 158 and air valve 164 will simultaneously close. When the system backpressure falls below the threshold value, the controller deactivates microswitch 180 thereby allowing spring return 190 to simultaneously open water valve 158 and air valve 164. The controller can be preset to a certain threshold pressure value, or can include means (such as a dial or keypad) to enter the threshold pressure desired by the operator.

In operation of the preferred embodiments described herein, the incoming static water pressure is generally set to a level in excess of the incoming static air pressure. The difference is not critical. The pressure at the periphery of the plates is determined by the outlet back pressure due to the chamber size, the hose, nozzle, and any orifice or restriction in the outlet side of the system. The pressure at the center of the plates is determined by the inlet water pressure, and the pressure available at the annular grooves is determined by the inlet air pressure. The back pressure at the periphery of the plates is at some level higher than atmospheric, but lower than either the pressure at the water inlet or the air inlet. Air is of course compressible, while water is not. It is believed therefore that due to the lower air pressure and the compressibility of the air, a balanced pressure between the air and water is reached at some radial point between the air inlet at the annular groove and the water inlet at the central bore. This radial equilibrium point will shift radially between the air and water inlets depending on the incoming volume and pressure of water, thus automatically balancing the two. As the back pressure changes, the pressure at the balance point will change proportionally. The balancing of the dynamic water pressure and air pressure is therefore automatic without the need for intervention by the user. This mechanism is believed to explain the operation of the present invention but the invention is not limited thereto. Additional adjustment of the mechanism to enhance the quality and quantity of the foam is possible through adjustment of the size of the restricted area between the two plates.

Furthermore, it is desirable that the proximity of the plates be such as to induce a high degree of turbulence into the mixing. This is accomplished by putting the two plates in close proximity. Thus a large proportion of the mixing takes place between the plates and the hose is not as necessary to act as a turbulent mixing chamber. This frees the operator from any problems involved in rebalancing the system when hoses or lengths of hoses are changed. Furthermore, since the hose is not occupied by unrestricted air, the hose may be operated at peak capacity resulting in maximum flow and increased trajectory for the foam exiting from the nozzle of the hose. Better mixing before the hose also allows better foam quality with finer structure when such is desirable. In those embodiments of the present invention utilizing plates that are movable relative to one another so as to vary the size of the restricted area between them, the water pressure within the mixing chamber may also be regulated by movement of the plates.

The present invention also has the advantage that it allows more flexibility in the use of pumps and compressors. As an example, one large pump might supply several foam lines independently of each other. Oversize pumps and compressors may be utilized without alteration. The present invention allows the air pressure to fluctuate which enables the compressor to cycle without adverse effect on the foam.

Although the preferred embodiment has been described with respect to a version of the present invention in which two plates are used and each plate introduces only water or air to the restricted area between for mixing, an alternative embodiment may employ two plates in which one plate serves as the impingement: surface and the other plate contains passages for introducing both pressurized air and a pressurized solution of water and surfactant. This arrangement utilizes the same principles for operation, but may have advantages allowing a compact design.

The present invention has been described with reference to certain preferred and alternative embodiments which are considered exemplary only and not limiting to the full scope of the invention as set forth in the appended claims.

What is claimed is:

1. An apparatus for generating foam comprising:

(a) a closed chamber;

(b) a pressurized liquid inlet connected to said chamber;

(c) a pressurized air inlet connected to said chamber;

(d) a generated foam outlet connected to said chamber for the exit of foam generated by combining said liquid and said air; and (e) two opposing plates positioned in said chamber spaced apart from each other, said plates forming a restricted area therebetween which is connected to both said liquid inlet and said air inlet wherein said liquid inlet passes through the center of one of said plates and said air inlet passes through one of said plates at a position radially outward from the center of said plate, thereby providing a lower pressure area between said liquid inlet and said air inlet for receiving and mixing said liquid and said air.

2. The apparatus of claim 1 wherein said air inlet includes an annular portion directing said air into said restricted area around the outside of said liquid inlet for thoroughly mixing said air and said liquid.

3. The apparatus of claim 1 wherein at least one of said plates is positioned generally transverse to said liquid inlet for impingement of said liquid thereon.

4. The apparatus of claim 3 wherein one of said plates is movably adjustable relative to the other of said plates.

5. The apparatus of claim 2 wherein said annular portion directs air inwardly towards said liquid inlet.

6. The apparatus of claim 5 wherein one of said plates is positioned relative to said air inlet to allow impingement of said air thereon.

7. The apparatus of claim 1 wherein one of said inlets includes an annular portion surrounding the outside of the other one of said inlets.

8. The apparatus of claim 1 wherein said opposing plates are generally circular and said inlets are generally connected transversely to one of said plates.

9. The apparatus of claim 1 wherein said plates are generally parallel to each other.

10. The apparatus of claim 9 wherein said plates form an annular outlet in communication with said chamber, and both of said inlets are connected to at least one of said plates inside of said annular outlet.

11. The apparatus of claim 1 including a control system connected to the apparatus, said control system limiting pressure at said outlet to no more than the lower of said air inlet and said liquid inlet pressure.

12. The apparatus of claim 11 wherein said control system simultaneously closes and opens said air and said liquid inlets.

13. An apparatus for generating foam, comprising:

(a) a dosed chamber;

(b) a first plate mounted within said chamber;

(c) a second plate mounted within said chamber proximate to said first plate wherein a restricted area is formed between said first plate and said second plate;

(d) a pressurized water and surfactant inlet connected to said chamber and passing through the center of one of said plates; and (e) a pressurized air inlet connected to said chamber and passing through one of said plates at a position that is radially outward from the center of said one of said plates, thereby forming a lower pressure area between said pressurized water and surfactant inlet and said pressurized air inlet for receiving and mixing water and surfactant and air.

14. The apparatus of claim 13, wherein said first and second plates are parallel.

15. The apparatus of claim 14, wherein said first and second plates are circular.

16. The apparatus of claim 13, further comprising means to adjust the restricted area between said first and second plates.

17. The apparatus of claim 13, wherein said means for introducing a solution of pressurized water and surfactant between said first and second plates is at least one water aperture through at least one of said first and second plates.

18. The apparatus of claim 17, wherein said means for introducing pressurized air between said first and second plates is at least one air aperture through at least one of said first and second plates.

19. The apparatus of claim 18, wherein said at least one water aperture and said at least one air aperture both pass through the same one of said first and second plates.

20. The apparatus of claim 18, wherein said at least one air aperture comprises an annular plurality of air apertures passing through at least one of said first or second plates, said annular plurality of air apertures circumscribing the center of said at least one of said first or second plates.

21. The apparatus of claim 18, wherein at least one of said first and second plates contains an annular groove in which said annular plurality of air apertures lies.

* * * * *